US009926614B2

(12) United States Patent
Tockert et al.

(10) Patent No.: US 9,926,614 B2
(45) Date of Patent: Mar. 27, 2018

(54) DEVICE FOR IMMOBILIZING THE CHUTE ON THE ENDS OF JOURNALS IN AN APPARATUS FOR LOADING A SHAFT FURNACE

(71) Applicant: Paul Wurth S.A., Luxembourg (LU)

(72) Inventors: Paul Tockert, Berbourg (LU); Ettore Rizzuti, Bascharage (LU)

(73) Assignee: PAUL WURTH S.A., Luxembourg (LU)

( * ) Notice: Subject to any disclaimer, the term of this patent is extended or adjusted under 35 U.S.C. 154(b) by 0 days.

(21) Appl. No.: 15/324,317

(22) PCT Filed: Jul. 2, 2015

(86) PCT No.: PCT/EP2015/065109
§ 371 (c)(1),
(2) Date: Jan. 6, 2017

(87) PCT Pub. No.: WO2016/005266
PCT Pub. Date: Jan. 14, 2016

(65) Prior Publication Data

US 2017/0175211 A1 Jun. 22, 2017

(30) Foreign Application Priority Data

Jul. 7, 2014 (LU) ..... 92494

(51) Int. Cl.
*C21B 7/20* (2006.01)
*C21B 7/18* (2006.01)
(Continued)

(52) U.S. Cl.
CPC ..... *C21B 7/20* (2013.01); *F27B 1/20* (2013.01); *F27D 3/10* (2013.01)

(58) Field of Classification Search
CPC ..... C21B 7/20; C21B 7/18; F27B 1/20; F27D 3/00; F27D 3/10
(Continued)

(56) References Cited

U.S. PATENT DOCUMENTS 3,756,582 A * 9/1973 Overmyer ..... C21O 5/40 266/158
3,814,403 A * 6/1974 Legille ..... C21B 7/20 414/206
(Continued)

FOREIGN PATENT DOCUMENTS

KR 1020130034289 A 4/2013
WO 0020647 A1 4/2000
(Continued)

OTHER PUBLICATIONS

International Search Report dated Sep. 1, 2015 re: Application No. PCT/EP2015/065109; pp. 1-3; citing: WO 2013/107078 A1, KR 2013-0034289 A, WO 2012/016818 A1 and WO 00/20647 A1.

*Primary Examiner* — Douglas A Hess
(74) *Attorney, Agent, or Firm* — Cantor Colburn LLP

(57) ABSTRACT

A device for immobilising the spout on the ends of the trunnions, in a charging installation for a shaft furnace comprising a pivoting material distribution spout (1), the spout being connected to the supporting trunnions (2) by lugs (11) which engage in receptacles (21) formed in the trunnions and which are immobilised therein by pins (3) comprising at their end an eccentric nipple (31) engaging with a lug of the spout to hold the lug immobilised at the bottom of its receptacle, and locking means (4) for rotationally locking the pin. Each pin comprises, at the outer, opposite end thereof from the nipple, means (32) for rotational adjustment and tightening, so as to be able to press the nipple onto the lug of the spout with sufficient force by rotation of the pin, and the locking means comprise an
(Continued)

indexing plate (41) connected for rotation to the end of the pin (3), the plate (41) further comprising teeth (416) arranged to cooperate with the corresponding teeth (421) of a lock (42) secured to the trunnion, in such a way that said lock can rotationally immobilise the pin in a plurality of circumferential positions of said pin.

15 Claims, 3 Drawing Sheets

(51) Int. Cl.
*F27B 1/20* (2006.01)
*F27D 3/00* (2006.01)
*F27D 3/10* (2006.01)

(58) Field of Classification Search
USPC ..... 414/199, 204, 206, 207
See application file for complete search history.

(56) References Cited

U.S. PATENT DOCUMENTS 4,273,492 A * 6/1981 Legille ..... C21B 7/20 414/160
4,306,827 A * 12/1981 Tsutsumi ..... F27B 1/20 193/16
4,368,813 A * 1/1983 Mailliet ..... C21B 7/20 193/16
4,493,600 A * 1/1985 Legille ..... C21B 7/20 266/176
4,525,120 A * 6/1985 Legille ..... C21B 7/20 193/16
4,729,549 A * 3/1988 Lonardi ..... C21B 7/20 266/176
4,941,792 A * 7/1990 Cimenti ..... C21B 7/20 239/659
6,916,146 B1 * 7/2005 Lonardi ..... C21B 7/20 414/172
7,311,486 B2 * 12/2007 Gorza ..... C21B 7/20 193/16
7,861,614 B2 * 1/2011 Sim ..... B65G 69/0441 414/206
8,419,336 B2 * 4/2013 Fletcher ..... C21B 7/20 414/207
8,485,345 B2 * 7/2013 Klutz ..... B65G 69/0458 198/535
8,820,250 B2 * 9/2014 Craig ..... C21B 7/20 110/267
9,389,019 B2 * 7/2016 Thillen ..... C21B 7/20
9,546,819 B2 * 1/2017 Thillen ..... C21B 7/20

FOREIGN PATENT DOCUMENTS

WO 2012016818 A1 2/2012
WO 2013107078 A1 7/2013

* cited by examiner

DEVICE FOR IMMOBILIZING THE CHUTE ON THE ENDS OF JOURNALS IN AN APPARATUS FOR LOADING A SHAFT FURNACE

FIELD OF THE INVENTION

The present invention relates to fixing a distribution spout of a charging installation of a shaft furnace, such as a blast furnace, on the trunnions supporting this spout and ensuring pivoting thereof. It relates more particularly to the system for immobilizing the spout on the ends of the trunnions.

BACKGROUND OF THE INVENTION

A charging installation of a shaft furnace typically comprises a stationary feed channel arranged vertically in the center of the furnace throat, centered on the vertical axis of the furnace, and a distribution spout for distributing the charged materials arriving via said channel in the furnace. In order to enable appropriate distribution of the charged material, the distribution spout may be rotated about said vertical axis and pivoted about a horizontal axis. To this end, the spout is typically mounted pivotably about said horizontal axis, in a shell mounted coaxially around said feed channel, and rotatably about the vertical axis. The spout is mounted pivotably in the shell by means of trunnions of a generally cylindrical shape with a horizontal axis, to which the spout is secured and which are mounted revolvably about said horizontal axis in bearings integral with the shell. In general, the shell is rotated and the spout pivoted by gear means located in an annular chamber surrounding the shell.

The spout is fixed on either side on radially inner ends, directed towards the vertical axis of the furnace, of the trunnions, which are driven pivotably by means of geared drive means located in said chamber surrounding the shell. Said drive means may act directly on the trunnions by meshing, or by means of arms or levers.

To ensure good operation of the spout, the latter must be joined integrally and rigidly to the trunnions. However, in particular to enable easy replacement of the spout, the latter is supported and fixed detachably to the trunnions.

To meet these two requirements of a rigid but nevertheless detachable connection, it is known to use a connection such as that illustrated in FIG. 1, where the spout 1 comprises towards its upper part fixing lugs 11 capable of engaging in receptacles 21 of a corresponding shape formed at the ends of the trunnions 2. It will be noted that the shapes of the lugs and of the receptacles are specifically designed to allow the lugs to engage in the receptacles, then, by relative pivoting, to apply the lugs at the bottom of the receptacles. Maintenance of this position is ensured by an immobilizing pin 3 which is removable to allow the spout lugs to be disengaged from the receptacles on the trunnions, but which has also to ensure that the lugs are mounted on the trunnions securely and without play.

Typically, the immobilizing pins comprise a cylindrical body mounted to slide and revolve in a bore formed in the trunnion and having an axis parallel to that of the trunnion, an eccentric nipple 31 formed at the end of the body located towards the spout, and rotation control and rotational locking means located at the opposite end of the pin body and accessible at the level of the outer, front end of the trunnion which is located in the annular chamber surrounding the shell. When the spout is put in place, once the lugs thereof have been positioned in the receptacles of the trunnions, the immobilizing pins are pushed axially into the bores in the trunnions until the eccentric nipples are inserted into holes formed to this end in the lugs of the spout. By pivoting the pins, and thanks to the eccentric nature of the nipples, the latter act on the lugs of the spout, pushing against the walls of the lug holes to push the latter into the bottom of their receptacles, so ensuring that the spout is mounted on the trunnions without play. To prevent the pin from being able to become disengaged by sliding axially, and to ensure also that the pin does not subsequently revolve during operation of the furnace, which could cause the spout to become detached, locking means are provided at the level of the opposite end of the pin from the nipple, to block any displacement of the pin both axially and in rotation. One particular problem is that rotational locking of the pin has to be ensured in various angular positions thereof, because this angular position is determined by cooperation of the eccentric nipple with the hole in the spout lug and, owing to the dimensional differences between the receptacles in the trunnion ends, the spout lugs, the nipples and the holes in which they engage, or indeed deformation or wear of these elements, said angular position of the pin, capable of ensuring correct immobilization of the spout, is variable from one instance of mounting to another, and/or must be capable of adjustment to ensure play-free maintenance of the assembly.

To respond to this issue, a known embodiment of these locking means consists of an arm secured to the end of the pin, which comprises at its end a screw and an adjusting and immobilizing nut, which makes it possible to immobilize said arm on the front end of the trunnion in various positions, thus immobilizing the pin in the desired position. In another embodiment, the arm is replaced by a flat lug which may be clamped on the front end of the trunnion in a plurality of positions.

One disadvantage of these systems for locking the immobilizing pins is that they take up a major part of the front end surface of the trunnion, while said surface is also occupied by the cooling duct connections formed in the trunnions for cooling the latter, as well optionally as the spout. Typically, these connections are additionally bulky because they comprise revolving joints, which are needed to join the pivoting trunnions to the stationary ducts for supplying cooling water. The result is that it is necessary to disassemble these revolving joints in order to access the locking means of the pins when it is necessary to act thereon, in particular when the spout is replaced. Consequently, in particular when a pressurized cooling system is used, it is then necessary to purge the circuit prior to disassembly, then to refill it. Errors may be made then and when the cooling system is being restarted. Furthermore, cooling of the trunnions is stopped during the entire spout replacement operation, while the trunnions remain exposed to the intense heat prevailing in the furnace.

BRIEF SUMMARY

The invention is intended to solve the above-mentioned problems. Its purpose is in particular to allow replacement of the spout without the need to disassemble the revolving joints. Its purpose is also to allow the cooling circuit to be kept in service during the spout changing operations. Its purpose is in particular to reduce the bulk of the locking means for the spout immobilizing pins, while nonetheless at the same time ensuring that this immobilization is reliable and providing the possibility of ensuring this in the various angular positions in which it may be necessary to place the pins to ensure immobilization without play of the spout lugs on the trunnions.

The invention provides a device for immobilizing the spout on the ends of the trunnions, in a charging installation for a shaft furnace as indicated above, comprising a material distribution spout mounted to pivot about a horizontal axis by means of trunnions rotating in fixed bearings of a supporting shell having a vertical axis of rotation, the spout being connected to the trunnions by lugs at the upper end of the spout which engage in receptacles formed in the inner ends of the trunnions and which are immobilized therein by pins accommodated in the trunnions and having an axis parallel to the axis of the trunnions, each pin comprising at its inner end oriented towards the vertical axis an eccentric nipple engaging with a lug of the spout to hold the lug immobilized at the bottom of its receptacle, and locking means for rotationally locking the pin.

According to the invention, this system is characterized in that each pin comprises, at the outer, opposite end thereof from the nipple, means for rotational adjustment and tightening, so as to be able to press the nipple onto the lug of the spout with sufficient force by rotation of the pin, and the locking means comprise an indexing plate connected for rotation to the end of the pin, said plate further comprising teeth arranged to cooperate with corresponding teeth of a lock secured to the trunnion, in such a way that said lock can rotationally immobilize the pin in a plurality of circumferential positions of said pin.

As will be understood better below, the device according to the invention ensures easy access to the pin simply by removing the indexing plate, which then allows the pin to be turned to release the spout lugs and then pulled axially to allow the spout lugs to move out of their receptacles in the trunnions, so permitting removal of the spout and replacement thereof. To achieve this, it is sufficient to be able to access the indexing plate fixing means, on the outer, front end of the trunnion, which may be done without acting on the other elements immobilized on said front end, such as in particular the revolving joints of the cooling circuit. When remounting the spout, the pin is put back in place, turned and tightened to ensure that the eccentric nipple presses on the spout lug, then locked in position by engaging the teeth of the indexing plate with those of the lock, as will be described in greater detail hereafter.

To allow said locking by engagement of the teeth, whatever the angular position of the pin, the indexing plate is connected for rotation to the pin by rotational connecting means arranged to ensure rotational connection in various relative angular positions. Once immobilization of the spout lugs has been obtained following rotation of the pin, it is sufficient to place the indexing plate on the pin in a position allowing engagement of its teeth with those of the lock.

Preferably, the rotational connecting means have a polygonal shape formed on the pin which cooperates with a cutout of suitable shape formed in the indexing plate. More preferably, the polygonal shape of the pin is hexagonal and the cutout in the indexing plate takes the form of a double hexagon. This arrangement thus makes it possible to adjust the relative angular position between the pin and the indexing plate by a pitch limited to 1/12 of a turn or an angle of 30 degrees.

According to a particular arrangement, the polygonal shape of the pin is continued towards the outer end of the pin so as also to serve as means for rotational adjustment and tightening, for example by an everyday type of polygonal key.

According to another particularly advantageous arrangement, the indexing plate is fixed to the outer, front end of the trunnion and serves as an axial stop for the pin, thereby preventing any risk of withdrawal of the pin due to axial sliding in the bore formed therefor in the trunnion.

Advantageously, the indexing plate is fixed to the trunnion by bolts passing through slots in the indexing plate, said slots taking the form of an arc of a circle centered on the axis of rotation of the pin. These slots allow the indexing plate to be fixed on the trunnion in a plurality of angular positions, limited only by the length of the slots, and therefore allows the indexing plate, and therefore the pin, to be positioned and held precisely in the angular position suitable for ensuring clamping of the spout lug in its receptacle.

The lock preferably comprises a plate comprising teeth which engage with the teeth of the indexing plate, the teeth of the indexing plate and of the lock plate being arranged along arcs of circles centered on the axis of rotation of the pin, so allowing locking of the indexing plate whatever the relative angular positions of the indexing and lock plates.

The lock plate is fixed to the outer, front end of the trunnion by bolts passing through slots in the lock plate, said slots taking the form of an arc of a circle centered on the axis of rotation of the pin. Furthermore, lateral stop means are provided to limit the travel of the lock plate in the circumferential direction. These lateral stop means preferably comprise a side wall of a receptacle formed in the outer, front end of the trunnion and in which the lock plate is fixed, said side wall of the receptacle serving as a stop for one end of the lock plate. This results in reliable locking of the pin in the position required for ensuring immobilization of the spout lugs by the eccentric nipple, by rotational connection of the pin with the indexing plate, then engagement of the teeth of the latter with the lock, and then immobilization of the lock by abutment in its receptacle.

It is also preferable for the ends of the lock plate to be offset by half a tooth pitch relative to the teeth of the lock plate. This arrangement makes it possible, by turning over the lock plate, to lock the pin rotationally with even finer adjustment of its angular positioning, down to an angular value corresponding to the angular value of half a locking tooth pitch.

According to a further arrangement, the indexing plate is accommodated in a receptacle formed at the front end of the trunnion, the receptacle comprising side walls which constitute stops for the pivoting of the indexing plate, with sufficient angular play to enable the indexing plate to be placed in its receptacle whatever the angular position of the pin. When the connection between the pin and the indexing plate is ensured by a hexagonal shape of the pin and a double hexagon shape of the cutout of the indexing plate in which said hexagonal shape of the pin engages, the angular play between the indexing plate and the lateral walls of its receptacle is typically 30 degrees. This means that the indexing plate may be placed in its receptacle in a plurality of angular positions over a 30 degree arc.

These various arrangements provide a triple safeguard against the risk of undesirable pivoting of the pin which could lead to disconnection of the spout from its trunnions: in a normal situation, the lock plate ensures rotational locking of the indexing plate and of the pin; if the lock plate were lost, the indexing plate would nevertheless ensure that the pin was held in place rotationally, being clamped by its fixing bolts; and if these bolts were to come loose, the pin could turn a maximum of a twelfth of a turn, being retained by abutment of the indexing plate in its receptacle. In this latter case, the spout could admittedly no longer be correctly held by clamping of its lugs in their receptacles in the front ends of the trunnions, but the lugs nonetheless could not become totally disengaged from their receptacles, and the spout would not therefore be lost as a result of its falling into the blast furnace.

BRIEF DESCRIPTION OF THE DRAWINGS

Other details and features of the invention will emerge from the following detailed description of one advantageous embodiment, provided by way of illustration with reference to the appended drawings, in which.

DETAILED DESCRIPTION

Figure 2:
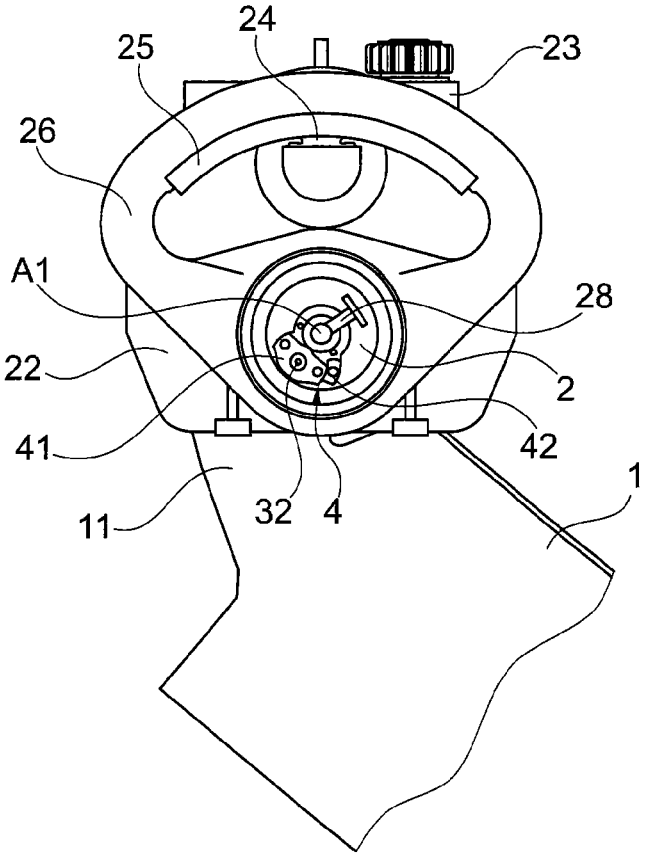
FIG. 2 is a general view of the system for supporting the spout and driving the pivoting movement thereof, viewed from the outer, front end of a trunnion.

The system for supporting the spout shown in FIG. 2 and for driving the pivoting movement thereof comprises, on each side of the spout, a bearing 22 in which the trunnion 2 is fitted to rotate about a horizontal axis A1 and driven pivotably by a mechanism comprising a gear casing 23, an output shaft of which bears a pinion 24 meshing with a toothed sector 25 of a control arm 26 connected for rotation with the trunnion.

Figure 1:
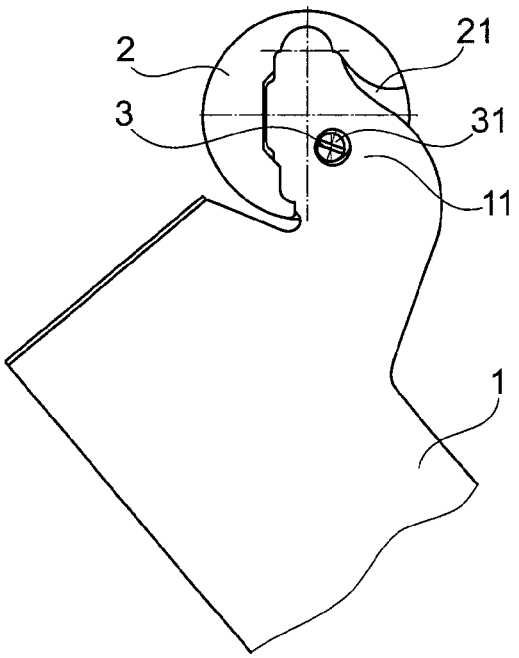
FIG. 1, which has already been commented on, is a view of the connection between the spout and the supporting trunnions.

On the outer, front end 29 of the trunnion 2, that is to say the opposite end face of the trunnion from the end comprising the receptacle 21 for the lugs 11 of the spout 1, revolving joints 28 are connected, so as there to connect ducts serving in internal cooling of the trunnions. Also visible, in an eccentric position relative to the axis A1, are the opposite end 32, hexagonal in shape, of the pin 3 from the eccentric nipple 31 which cooperates with the lug 11 of the spout to immobilize it in its receptacle 21, as indicated at the beginning of this description in relation to FIG. 1, and the means 4 for rotationally immobilizing the pin 3 on the trunnion, which particularly comprise an indexing plate 41 and a locking plate 42.

Figure 3:
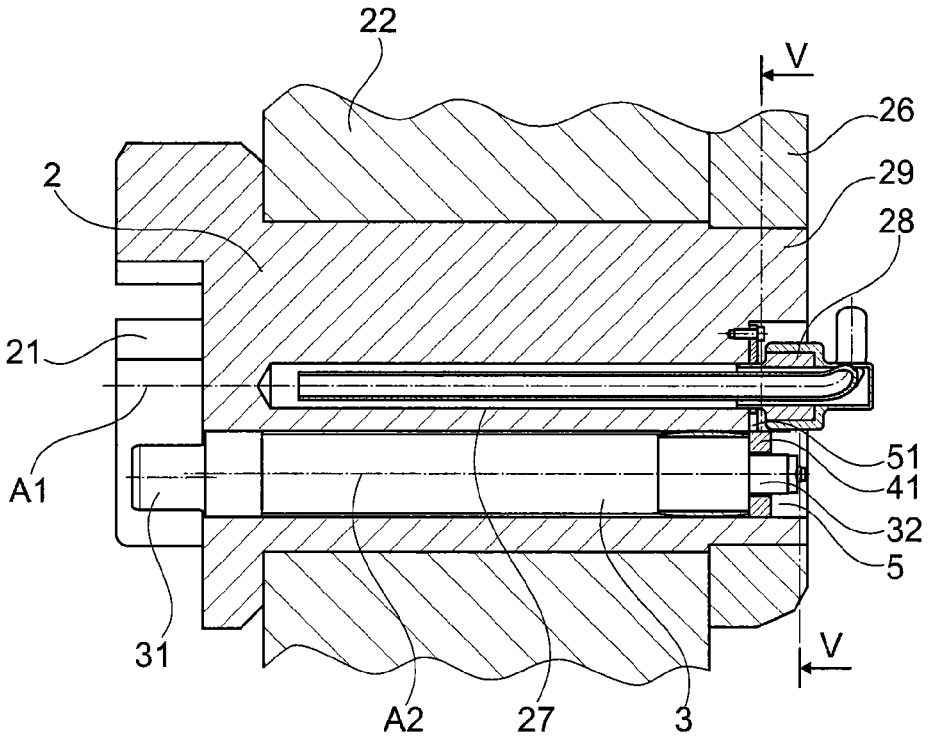
FIG. 3 is a view in axial section of the trunnion, in the radial plane containing the pin.

FIG. 3, which shows a trunnion in axial section, reveals the trunnion 2 mounted in the bearing 22 for rotation about the horizontal axis A1, together with the receptacle 21 intended to receive the lug 11 of the spout, and an axial cooling channel 27 to which the revolving joint 28 is connected.

The pin 3 is mounted to revolve and slide in an axial bore A2 of the trunnion parallel and eccentric relative to the axis A1. Its inner end, located towards the spout, comprises the eccentric nipple 31 which, in the spout immobilizing position, protrudes axially into the receptacle 21 so as to engage in the hole formed to this end in the lug 11 of the spout. At its outer, opposite end 32 from the nipple 31, the pin takes the form of a hexagon 321 which is engaged with a hole in the form of a double hexagon 411 formed in the indexing plate 41, and protrudes beyond this plate so that a tightening key can be positioned thereon to turn the pin 3 about its axis A2 and thus to turn the eccentric nipple and immobilize the spout lug in its receptacle, as indicated above. The indexing plate 41 is accommodated in a receptacle 5 formed to this immobilizes outer, front end of the trunnion and, being fixed at the bottom of this receptacle, axially immobilizes the pin to prevent the eccentric nipple from becoming disengaged from the hole in the spout lug due to axial sliding of the pin.

Figure 4:
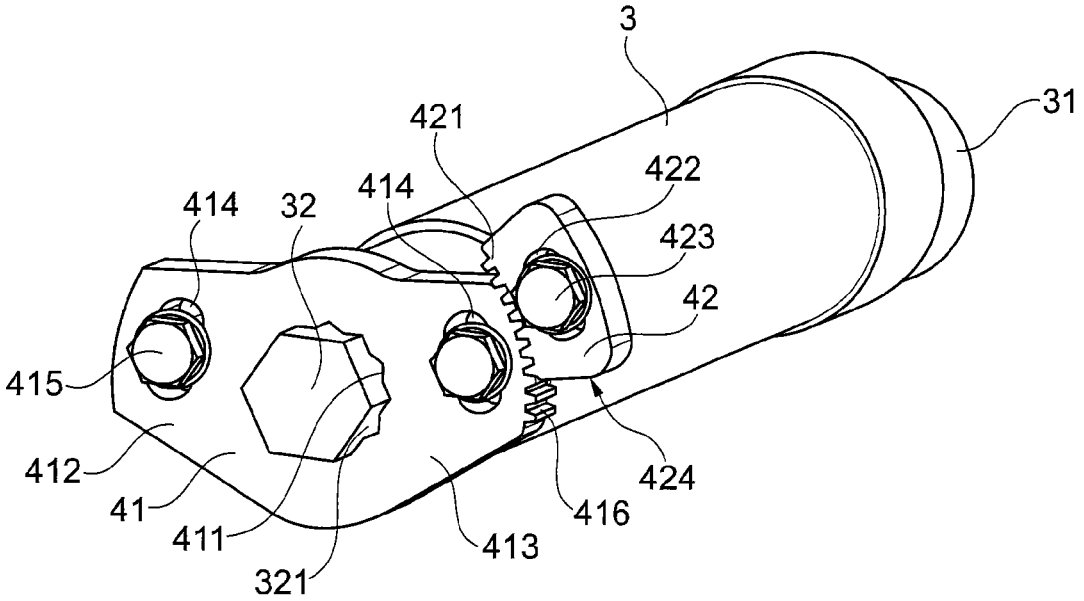
FIG. 4 is a perspective view of the pin equipped with the indexing plate and with the locking plate.
Figure 5:
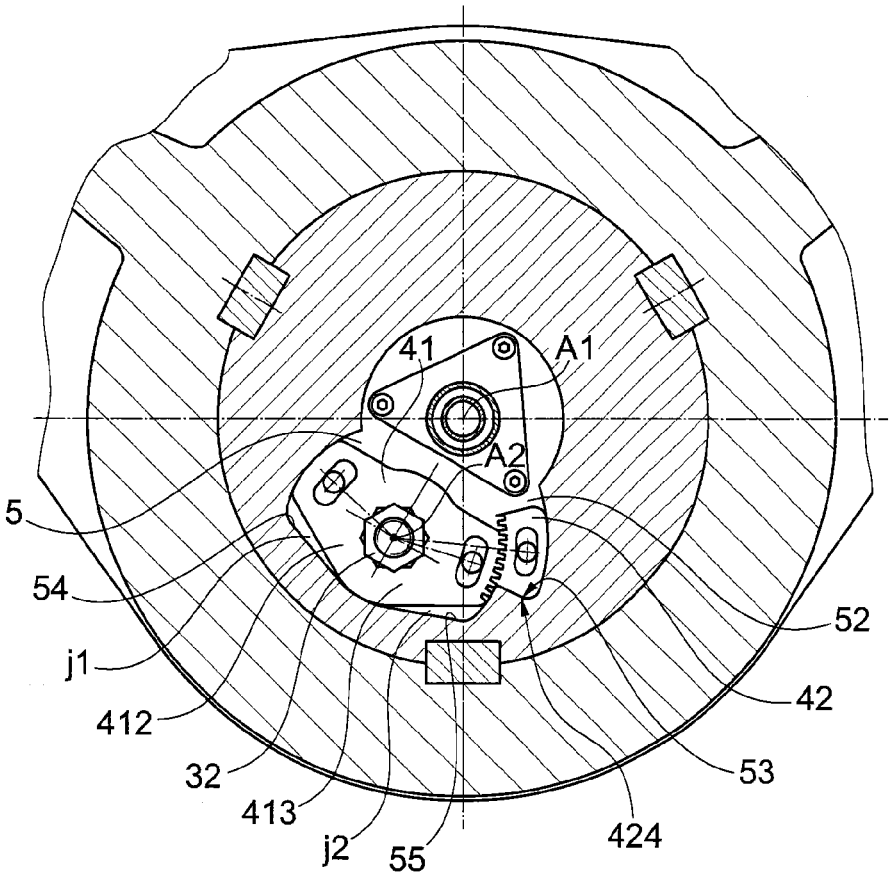
FIG. 5 is a view in cross-section along line V-V of FIG. 3.

As can readily be seen in FIGS. 4 and 5, the indexing plate 41 comprises two arms 412, 413 extending in substantially diametrically opposed directions, in which oblong slots 414 are formed in arcs of circles centered on the axis A2 of the pin. Fixing bolts 415, passing through these slots and screwed into the trunnion, allow the indexing plate 41 to be clamped against a front wall 51 constituting the bottom of the receptacle 5, so rotationally immobilizing the indexing plate and therefore the pin.

One of the arms 413 bears at its end spur teeth 416 in the form of an arc of a circle, centered on the axis A2, which engage with corresponding teeth 421 formed on the locking plate 42. The locking plate 42 comprises an oblong slot 422 through which passes a bolt 423 for fixing the locking plate in the receptacle 5 of the trunnion.

The locking plate 42 is accommodated in one part 52 of the receptacle 5 comprising a side wall 53 arranged to receive in abutment one of the ends 424, 425 of the locking plate 42. The receptacle 5 further comprises two side walls 54, 55 facing the side faces of the arms 412 and 413, but arranged so that play j1, j2 remains overall between said arms and said side walls, allowing overall an angular clearance j1+j2 of the indexing plate which is equal to, or slightly greater than, 30°, this being necessary to allow the indexing plate 41 both to be placed in the receptacle 5 and on the hexagonal end 32 of the pin 2, whatever the angular position of said pin.

Figure 6:
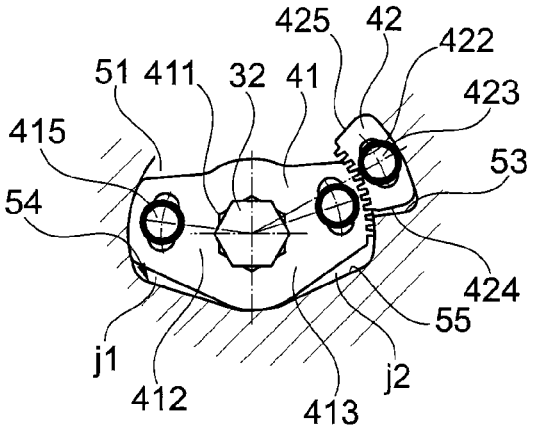
FIGS. 6 and 7 show two alternative positions of the locking plate engaged with the teeth of the indexing plate.
Figure 7:
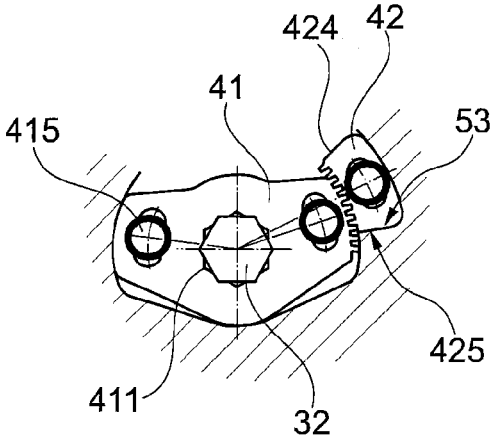

As can be seen in FIGS. 6 and 7, the ends 424, 425 of the fixing plate are offset by half a pitch relative to the teeth, such that, by turning the plate over, it is possible as far as possible to ensure, whatever the angular position of the pin and of the indexing plate, both engagement of the teeth of the indexing plate and of the locking plate, and abutment of the locking plate against the side wall 53 of its receptacle. Thus if, as a result of the angular position in which the pin is located after having immobilized the spout by rotation of said pin, engagement of the teeth would lead, with the locking plate facing in a first direction, to play between the end 424 of the locking plate and the side wall 53 as shown in FIG. 6, it is possible to eliminate or at least reduce this play by turning over the locking plate such that the other end 425 is then in abutment, without play, against the side wall 53, as shown in FIG. 7.

To put a spout 1 in position, the lugs 11 thereof are placed in the receptacles 21 of the supporting trunnions 2. Then, on each side, the pin 3 is pushed axially so as to cause the eccentric nipple 31 to penetrate into the hole in the lug 11. By means of a key engaged with the six-sided end 32 of the pin, it is possible to turn the pin until the nipple 31 immobilizes the lug 11 in the receptacle 21. In this position, the indexing plate 41 is adjusted on the hexagon 321 of the end of the pin such that said plate is inserted into the receptacle 5 in the front end of the trunnion with minimum play, and the bolts 415 are tightened so as to clamp the indexing plate 41 against the bottom 51 of its receptacle, so immobilizing the pin axially and rotationally. The locking plate 42 is then positioned in the direction which ensures zero or minimal play between the end 424 or 425 of the locking plate and the wall 53 of its receptacle, and the locking plate retaining bolt 423 is tightened.

Thanks to the various relative angular positions between the pin and the indexing plate which may be obtained by engagement of the double hexagon shape of the indexing plate with the hexagonal shape 321 of the end of the pin, and thanks to the teeth 416, 421, which may engage respectively with an angular pitch corresponding to the pitch of the teeth, and thanks to the possibility of turning the locking plate over, it is ultimately possible to ensure reliable, virtually play-free locking of the pin whatever its angular position. Moreover, as already indicated, there is a triple safeguard, making it possible to prevent the spout from falling off even if the locking plate were to disappear and the bolts of the indexing plate to come loose.

The invention is not limited to the embodiment described above by way of example. Instead of a hexagonal shape at the end of the pin to allow rotation thereof by a key, any other form could be used provided it fits with the tightening tool used. The hexagonal and double-hexagonal shapes of the connection between the indexing plate and the pin could also be replaced by other polygonal shapes with the same function, for example a square on the pin and a double square in the indexing plate, the play j1 and j2 then being adapted accordingly.

The invention claimed is:

1. A device for immobilizing a spout on ends of trunnions, in a charging installation for a shaft furnace comprising a material distribution spout mounted to pivot about a horizontal axis by means of the trunnions rotating in bearings of a supporting shell having a vertical axis of rotation, the spout being connected to the trunnions by lugs at an upper end of the spout which engage in receptacles formed in inner ends of the trunnions and which are immobilized therein by pins accommodated in the trunnions and having an axis parallel to the axis of the trunnions, each pin comprising at an inner end oriented towards the vertical axis an eccentric nipple engaging with a lug of the spout to hold the lug immobilized at a bottom of a receptacle, and locking means for rotationally locking the pin, wherein each pin comprises, at an outer, opposite end thereof from the nipple, means for rotational adjustment and tightening, so as to be able to press the nipple onto the lug of the spout with sufficient force by rotation of the pin, and wherein the locking means comprises an indexing plate connected for rotation to the end of the pin, the indexing plate further comprising teeth arranged to cooperate with corresponding teeth of a lock secured to the trunnion, in such a way that said lock can rotationally immobilize the pin in a plurality of circumferential positions of said pin.

2. A device according to claim 1, wherein the indexing plate is connected for rotation to the pin by rotational connecting means arranged to ensure rotational connection in various relative angular positions.

3. A device according to claim 2, wherein the rotational connecting means have a polygonal shape formed on the pin which cooperates with a cutout of suitable shape formed in the indexing plate.

4. A device according to claim 3, wherein the polygonal shape of the pin is continued towards the outer end of the pin so as also to serve as means for rotational adjustment and tightening.

5. A device according to claim 3, wherein the polygonal shape of the pin is hexagonal and the cutout in the indexing plate takes the form of a double hexagon.

6. A device according to claim 1, wherein the indexing plate is fixed to an outer, front end of the trunnion and serves as an axial stop for the pin.

7. A device according to claim 1, wherein the indexing plate is fixed to the trunnion by bolts passing through slots in the indexing plate, said slots comprising an arc of a circle centered on the axis of rotation of the pin.

8. A device according to claim 1, wherein the lock comprises a plate comprising the teeth of the lock which engage with the teeth of the indexing plate.

9. A device according to claim 8, wherein the teeth of the indexing plate and of the lock plate are arranged along arcs of circles centered on the axis of rotation of the pin.

10. A device according to claim 8, wherein the lock plate is fixed to the outer, front end of the trunnion by bolts passing through slots in the lock plate, said slots comprising arcs of circles centered on the axis of rotation of the pin.

11. A device according to claim 8, comprising lateral stop means for limiting travel of the lock plate in a circumferential direction.

12. A device according to claim 11, wherein the lateral stop means comprise a side wall of a receptacle formed in the outer, front end of the trunnion and in which the lock plate is fixed, said side wall of the receptacle comprising a stop for one end of the lock plate.

13. A device according to claim 12, wherein the ends of the lock plate are offset by half a tooth pitch relative to the teeth of the lock plate.

14. A device according to claim 8, wherein the indexing plate is accommodated in a receptacle formed at the front end of the trunnion, the receptacle comprising side walls which constitute stops for the pivoting of the indexing plate, with angular play to enable the indexing plate to be placed in the receptacle whatever the angular position of the pin.

15. A device according to claim 14, wherein the indexing plate is connected for rotation to the pin by rotational connecting means arranged to ensure rotational connection in various relative angular positions, wherein the rotational connecting means have a polygonal shape formed on the pin which cooperates with a cutout of suitable shape formed in the indexing plate, wherein the polygonal shape of the pin is hexagonal and the cutout in the indexing plate takes the form of a double hexagon, and wherein an angular play between the indexing plate and the side walls of the receptacle thereof is 30 degrees.

* * * * *